US007448170B2

(12) United States Patent
Skendžić et al.

(10) Patent No.: US 7,448,170 B2
(45) Date of Patent: Nov. 11, 2008

(54) INDIRECTLY PRESTRESSED, CONCRETE, ROOF-CEILING CONSTRUCTION WITH FLAT SOFFIT

(75) Inventors: Milovan Skendžić, Lepoglava (HR); Branko Šmrček, Trnovec (HR)

(73) Assignee: Mara-Institut d.o.o., Donji Martijanec (HR)

( * ) Notice: Subject to any disclaimer, the term of this patent is extended or adjusted under 35 U.S.C. 154(b) by 455 days.

(21) Appl. No.: 10/489,952

(22) PCT Filed: Nov. 19, 2002

(86) PCT No.: PCT/HR02/00057

§ 371 (c)(1),
(2), (4) Date: Oct. 8, 2004

(87) PCT Pub. No.: WO03/060253

PCT Pub. Date: Jul. 24, 2003

(65) Prior Publication Data

US 2005/0072065 A1 Apr. 7, 2005

(30) Foreign Application Priority Data

Jan. 16, 2002 (HR) ..... P 20020044 A

(51) Int. Cl.

| | |
|---|---|
| ***E04B 1/32*** | (2006.01) |
| ***E04B 7/02*** | (2006.01) |
| ***E04B 7/08*** | (2006.01) |
| ***E04C 5/08*** | (2006.01) |
| ***E04C 3/02*** | (2006.01) |
| ***E04C 3/30*** | (2006.01) |
| ***E04H 12/00*** | (2006.01) |

(52) U.S. Cl. ..... 52/90.1; 52/223.8; 52/223.1; 52/640; 52/690; 52/639; 52/88

(58) Field of Classification Search ..... 52/90.1, 52/223.8, 223.14, 223.12, 223.1, 223.9, 223.11, 52/319, 640, 690, 724.1, 691, 692, 86, 88, 52/639, 650.1, 650.2
See application file for complete search history.

(56) References Cited

U.S. PATENT DOCUMENTS

| | | | |
|---|---|---|---|
| 2,809,074 | A | 10/1957 | McDonald |
| 3,260,024 | A | 7/1966 | Greulich |

(Continued)

FOREIGN PATENT DOCUMENTS

| | | |
|---|---|---|
| FR | 2 600 358 | 12/1987 |
| GB | 586394 | 3/1947 |

*Primary Examiner*—Brian Glessner
*Assistant Examiner*—Branon C Painter
(74) *Attorney, Agent, or Firm*—Jacobson Holman PLLC

(57) ABSTRACT

An indirectly prestressed concrete roof-ceiling construction is a prefabricated element for constructing large-span industrial buildings. The construction includes a distinctly wide and thin concrete soffit plate and an upper concrete girder of an inverse "V"-shaped cross section, interconnected by slender steel pipe-rods that are used to stabilize the upper girder against lateral buckling and to prevent the plate and the girder from getting closer or further away from each other. Prestressing of the soffit plate causes compression in the upper girder which passively (indirectly) pushes the ends of the construction, acting on some eccentricity over the center of gravity of the cross section, causing rotation of its ends, bending in that way the soffit plate upwards. There are two efficient methods of prestressing these constructions.

4 Claims, 2 Drawing Sheets

U.S. PATENT DOCUMENTS 4,912,794 A * 4/1990 Thivans ..... 14/3
5,390,453 A * 2/1995 Untiedt ..... 52/90.1
5,671,573 A * 9/1997 Tadros et al. ..... 52/223.8
5,884,442 A * 3/1999 Breault ..... 52/245
6,966,159 B2 * 11/2005 Skendzic et al. ..... 52/223.14

* cited by examiner

INDIRECTLY PRESTRESSED, CONCRETE, ROOF-CEILING CONSTRUCTION WITH FLAT SOFFIT

This is a nationalization of PCT/HR02/00057 filed Nov. 19, 2002 and published in English.

TECHNICAL FIELD

The present invention relates to the construction of roofs of industrial building or other similar buildings of prestressed, reinforced concrete and in particular some steel parts become integral parts of the structure.

The field of the invention is described in IPC Classification E 04 B 1/00 that generally relates to constructions or building elements or more particularly group E 04 C 3/00 or 3/294.

BACKGROUND ART

The present invention deals with a specific flat-soffit roof-ceiling construction of an original concept and shape. Although some similarities to trusses or tied arches are obvious the present construction substantially differs from them in the manner of how it works bearing the load. First of all, these constructions are intended to solve both the finished ceiling with flat soffit and the roof construction simultaneously. It is intended also to use the wide soffit plate to contribute as a bearing element instead of being passively hung on a truss or an arch.

All the other practical intentions of the present construction include Advantages disclosed by HR-P20000906A that these constructions have when compared to customary roofs and ceilings.

The commonly used prestressing techniques that introduce compressive force into a structural member of a selected geometry cross-section with tendons positioned below the concrete center of gravity would not achieve proper effects when applied to these constructions because of the absence of such an eccentricity. An achievement of upward deflection of the concrete plate would require lowering of the prestressing tendons below the center of gravity of the overall construction which is unacceptable because it would ruin the idea of the flat soffit. The problem is hence focused to find out an adequate prestressing method which may efficiently reduce the large amount of deflections and eliminate or control cracks in concrete which may occur if tension in the soffit plate is allowed. The present invention provides one more efficient method for prestressing constructions having a flat soffit. The present construction also solves the problem of stability of the upper girder against lateral buckling.

The HR-P20000906A application, under the name "Doubly prestressed, composite, roof-ceiling construction with flat soffit for large span buildings" is the most similar known construction. The just mentioned application proposes one efficient method for prestressing of such inverse constructions with a low positioned center of gravity of the cross section and discloses another solution: The wide plate is prestressed once, centrically, before the construction is completed, introducing compression into the soffit plate wherewith the cracks problem in concrete is solved. The construction is then completed and is prestressed once again by means of a steel wedge driven into a special detail positioned at a midspan of the upper girder to achieve an upward deflection of the plate by rotating its ends.

The present invention relates to a very similar but substantially changed construction from the one disclosed in HR-P20000906A. One more additional prestressing is provided. In comparison to the abovementioned innovation the present construction introduces the stiff upper girder with such a design of the cross-sectional shape which is simultaneously rigid and thin-walled, intended to reduce an effective length of the interconnecting pipe-rods compared to considerably stiff steel tubes. Replacement of stiff steel tubes by slender pipe-rods disables transmission of bending moments from the upper girder to the plate and vice versa. The interconnecting pipe-rods are spaced uniformly over the soffit plate to improve the interconnection and uniformity of the plate weight distribution on the upper girder. Hence, the connections between rods and the plate became less rigid so that the prestressing force introduced in the soffit plate causes no considerable bending of rods and enables a larger amount of prestressing to be applied without bending the plate. However, if the centric prestressing of the soffit plate is performed in a small amount it does not significantly influence the deflection of the plate. If, in contrast in contrast, a large amount of prestressing force is applied at a high compression levels, considerable influences are applied to deflections of the soffit plate. It is one important object of the present invention to provide one more efficient manner of prestressing constructions with the flat soffit while not disputing double prestressing as a very efficient method.

The present construction solves the problem of stabilizing the upper girder against lateral buckling more efficiently than the abovementioned application. The space-distributed connecting rods, distributed uniformly over the upper plane of the ceiling plate at certain, determined distances, divide the overall effective length of the upper girder into a plurality of smaller lengths whereby the cross section of the upper girder is of an inverse "V" shape that shortens the effective lengths of interconnecting rods and changes their end conditions, reducing additionally their effective lengths of buckling.

BRIEF DESCRIPTION OF THE DRAWINGS

Description of the Drawings

Figure 1:
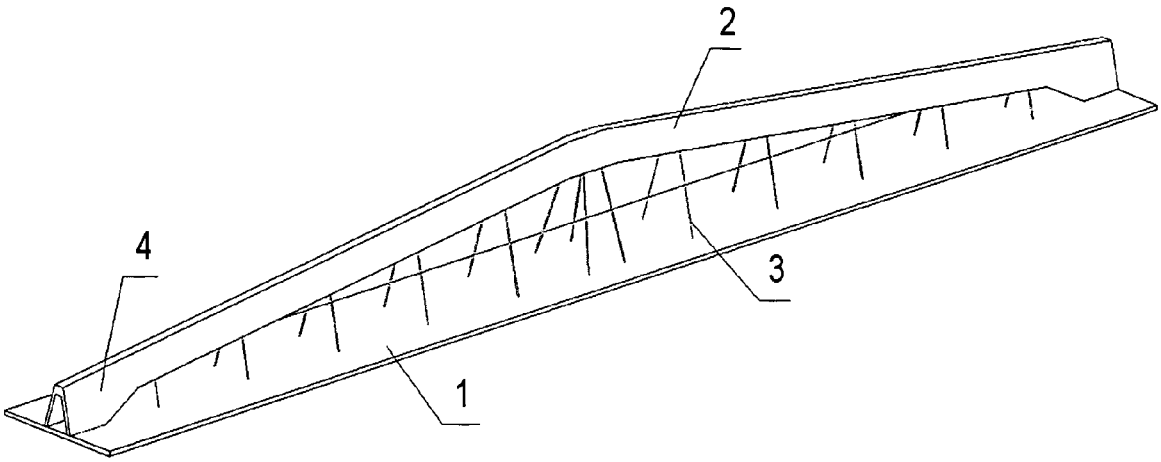
Figure 2:
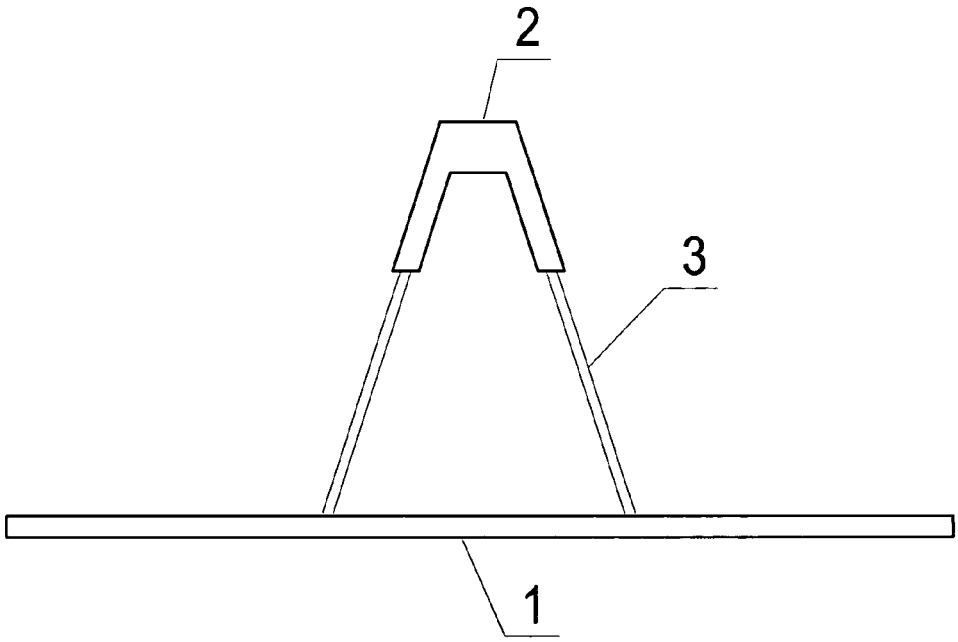
Figure 3:
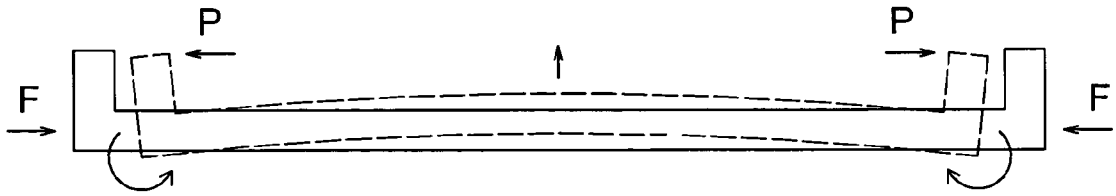
Figure 4:
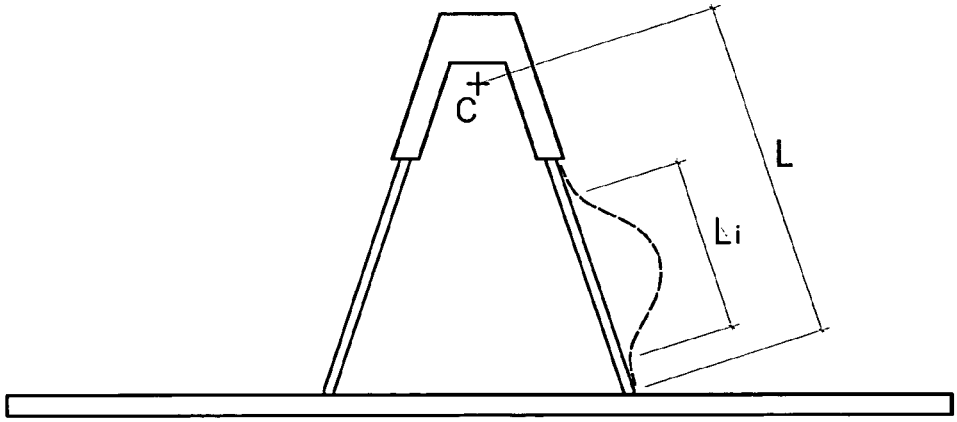

FIG. 1. presents an isometric view of the construction showing its constitutive parts, FIG. 2. is a cross section of the construction showing its constitutive parts FIG. 3. illustrates on a simplified model the principle of prestressing (CASE 1), and FIG. 4. illustrates the reduction of the effective length of the interconnecting rod (3) and the manner of how the upper girder (2) is stabilized against lateral buckling.

DETAILED DESCRIPTION OF THE PREFERRED EMBODIMENTS

The prestressed roof-ceiling construction of the present invention is a one-way bearing prefabricated element with space-distributed connecting rods for constructing industrials, large-span buildings. The construction includes a distinctly wide and thin concrete plate (1) and an upper concrete girder (2) of an inverse "V"-shaped cross section, as shown in FIG. 2, interconnected by slender steel pipe-rods (3). The thin soffit plate is chosen to be distinctly wide to cover a great portion of the site plan of the building at one time and to provide a flat soffit in an interior space.

It is obvious from FIG. 2 and FIG. 4 that both thin walls of the cross section of the upper girder (2) are extended to be close to the plate (1) shortening in that way a buckling length of interconnecting pipe-rods (3). The interconnecting pipe-rods (3) anchored at one side to the upper girder (2) and having the same inclination as sloped thin walls of the cross-section of the girder (2) are on the opposite side anchored into the wide soffit plate (1) stabilizing in that way the upper girder (2) against lateral buckling.

The slender, space distributed steel pipe-rods (3) are also utilized to maintain a distance between the soffit plate (1) and the upper girder (2), preventing transition of bending moments in both directions and reducing thermal conductivity between the upper girder (2) and the soffit plate (1).

To illustrate how the construction mechanism works the following consideration is made:

If the construction was not prestressed, both the soffit plate (1) and the upper girder (2) would tend to bent downwards whereby the soffit plate (1), because of its higher weight to vertical stiffness ratio, would bend at a faster rate than the upper girder (2) and would activate the interconnecting rods (3) to resist movement apart.

If the construction was prestressed and not loaded, the interconnecting elements (3) would be compressed, resisting movement of the soffit plate (1) and the upper girder (2) from approaching each other.

If the construction is prestressed and only the upper girder was loaded, compression in the interconnecting rods (3) would increase because in that case the upper girder (2), due to applied load, bends downwards while, at the same time, the soffit plate bends slightly upward so that the interconnecting elements (3) resist their approach to each other.

In any case, the upper girder (2) acts as a bearing element that bears almost the entire bending moment whereby elements (3) are constructed so that they are capable to transmit only a small amount of bending moments to the soffit plate (1) which is very easy to deflect even under bending moments of very low amounts.

The slender interconnecting rods as a part of the construction play generally a role of a kind of "passive" connectors which are not stressed significantly in any case of loading although they interconnect the two massive concrete parts of the construction, plate (1) and girder (2) keeping the distance between them as they tend to move closer or apart from each other under different load cases. It is also possible to find such a combination of load and prestressing at which inner forces in some interconnecting rods are very small or practically equal to zero that emphasizes the difference between the present constructions as compared to prior trusses or tied arches. This will be clearer from the following, when prestressing will be considered.

There are two available methods of prestressing such constructions where the choice depends on whether we want to have more or less compressed both the soffit plate (1) and the upper girder (2) or some moderate tension will be allowed in the concrete of the soffit plate (1). If the first option is chosen, it leads to the double prestressing method case disclosed in HR-P20000906A whereby the upper girder (2) should be made of two parts with a disconnection at the midspan. If the other option is chosen the upper girder (2) is made in only one piece.

In order to better explain the difference, from the following, the example with the girder of one piece is noted as CASE 1 and the example with a two part upper girder is denoted as CASE 2. (CASE 2 is not the matter of the present invention and is only mentioned here as a possible variant).

Case 1

This case is illustrated in FIG. 1. As it is obvious from the picture, the upper girder (2) is made of one part. Its ends (4) may be considered as short consoles (no matter whether we consider them to be an integral part of the soffit plate or of the upper girder) that are rigidly connected to the soffit plate (1) and are capable of transmitting the bending moments from the upper girder (2). The upper girder (2) is first cast in its own mould and then placed into the soffit plate (1) mould. The prestressing wires are tensioned and anchored at the mould of the soffit plate and the plate (1) is poured. After concrete hardening, the upper girder (2) and the soffit plate (1) become connected by a special detail near supports, the prestressing tendons are released from the mould and the centric prestressing force is introduced into the concrete of the soffit plate (1). The prestressing force shortens the soffit plate (1) causing thereby a mutual displacement of both of the ends (4) of the upper girder (2) towards each other. Both ends of the upper girder (2) are rigidly connected to the soffit plate (1) over long connecting lines so that the bending moment can be transmitted at such places into the soffit plate (1). Because of their mutual displacement-deformation both the upper girder (2) and the soffit plate (1) contribute some part of an introduced prestressing force. Considering the support ends (4) of the upper girder (2) as short consoles that are an integral part of the soffit plate (1) it is obvious that the shortening of the soffit plate (1) pushes ends of the upper girder (2) towards eachother whereby the upper girder (2) bends upwards, resisting in that way their common shortening. As a reaction, the ends (4) of the upper girder (2) with a major contributing part of the prestressing force, push the consoles, at ends of the soffit plate (1), rotating their ends and producing negative bending moments in the soffit plate (1), bending it upwards. The interconnecting rods (3) between the soffit plate (1) and the upper girder (2) are thereby exposed to a slight compression as they resist their approach each to each other. The soffit plate is prestressed directly to prevent cracks from occurring in the concrete caused by high level tensions, but the main effect is the upward deflection of the; thin and slender but weighty, soffit plate that is achieved due to indirect passive reaction of the upper girder (2) acting through both its console-like supports. Hence, the effect of pushing ends is achieved in the same manner as it was achieved in abovementioned HR-P20000906A. The long and slender soffit plate (1) bends at a faster rate than the upper girder (2) so that restricted differences between their deflections cause compression in the interconnecting rods (3).

Case 2

According to what was described in application HR-P20000906A, the upper girder (2) was made of two parts and prestressed by a double prestressing method, performed in two steps, whereby in the first step the soffit plate (1) is prestressed centrically, before the two separated parts of the upper girder become connected at the midspan, so that the first prestressing does not induce any stresses in disconnected halves of the upper girder. In the other step, at the interrupting point of the upper girder at the midspan a steel wedge driven into a special detail cause both sides pushing apart of the supports, deflecting thereby the soffit plate upwards due to the rotation of its ends.

In both compared methods the negative bending moment is achieved through rotating ends of the construction to accomplish the upward deflection. But there is a significant difference between CASE 1 and CASE 2 that allows us to prestress the construction with a smaller or larger forces spending thereby more or less on prestressing steel, respectively.

In practice, in some cases, each of the two considered methods may have some advantages or disadvantages or can be restricted by different reasons.

CASE 1 generally requires application of a larger amount of prestressing force than CASE 2, the force that is capable of shortening the soffit plate (1) and to simultaneously bend upwards the upper girder (2). The soffit plate is then stressed at a high compression level so that in that case, an increased expense occurs that has to be compared to the expense of the case when both the wedge and fewer cables are applied. If for some reason it is not necessary to prestress the soffit plate (1) to a large amount it is reasonable to apply some moderate forces spending thereby less on cables. In that case the upward bending of the soffit plate (1) has to be done anyway so that CASE 2 would be more economical.

Of course, there are lots of possible combinations that may appear of varying height or different ratios of the upper girder dimensions, shapes, thickness or width of the soffit plate or applying different density materials (for instance lightweight concrete), varying the prestressing force amounts in both elements (1) and (2) whereby some optimum always exists.

As a special case it is also possible to utilize the combination of both abovementioned cases whereby the wedge for additional prestressing is positioned into a connecting detail before the prestressing of the soffit plate is performed so that the wedge is used after the first prestressing for fine leveling of the upward deflection of the soffit plate.

The upper girder (2) is first cast in its own mould and then placed into the soffit plate (1) mould. Prestressing wires are tensioned on the mould of the soffit plate (1) and the plate is poured. After the concrete of the soffit plate (1) is hardened, both of the elements are connected (the upper girder (2) and the soffit plate (1) by special details near the supports. As the soffit plate mould is released the centric prestressing force is introduced into the concrete of the soffit plate (1). Both the applied amounts of compression and tension must be previously estimated numerically and decided by an engineer.

The invention claimed is:

1. A prefabricated building element used as an indirectly prestressed, concrete, roof-ceiling construction with flat soffit for constructing large-span industrial buildings, the prefabricated building element comprising a lower, distinct wide and thin concrete soffit plate, an upper thin walled, cross sectional inverse "V" shaped upper concrete girder having two ends, said concrete girder being of one-piece construction between said two ends and said girder being spaced from the soffit plate except at the two ends of the girder, the concrete plate and the girder being interconnected by distributed slender steel pipe-rods, the soffit plate being prestressed centrically.

2. The prefabricated building element according to claim 1, wherein deflection control of the soffit plate is performed by indirect prestressing of the soffit plate causing a passive reaction of the upper girder towards both of the ends and bending upwards of the soffit plate through rotation of the ends.

3. The prefabricated building element according to claim 1, wherein the upper girder is prevented against lateral buckling by the steel pipe-rods with the rods inclined, following a slope of the inverse "V" cross section of the upper girder.

4. A prefabricated building element used as an indirectly prestressed, concrete, roof-ceiling construction with flat soffit for constructing large-span industrial buildings, the prefabricated building element comprising a lower flat concrete soffit plate, an upper concrete girder, said girder having a cross-sectional inverted V shape continuously maintained between two ends of the concrete girder, said concrete girder being of one-piece construction between said two ends, said cross-sectional inverted V shape having a cross piece and two legs extending from said cross piece, said two legs being thinner than said cross piece, and a plurality of spaced rods extending from the legs of the girder at an angle of inclination equal to an angle of inclination of the legs of the girder, said rods interconnecting said concrete soffit plate and said concrete girder, the two ends of said concrete girder being connected directly to said soffit plate.

* * * * *